US007065908B1

(12) United States Patent
Pineda-Sanchez et al.

(10) Patent No.: US 7,065,908 B1
(45) Date of Patent: Jun. 27, 2006

(54) SNOW GLOBE ASSEMBLY

(76) Inventors: Juan Ramon Pineda-Sanchez, 482 Julian St., Turlock, CA (US) 95380; Maria Garcia-Pineda, 482 Julian St., Turlock, CA (US) 95380

( * ) Notice: Subject to any disclaimer, the term of this patent is extended or adjusted under 35 U.S.C. 154(b) by 272 days.

(21) Appl. No.: 10/228,381

(22) Filed: Aug. 27, 2002

(51) Int. Cl.
*G09F 19/00* (2006.01)

(52) U.S. Cl. ..... 40/406; 40/409
(58) Field of Classification Search ..... 40/406, 40/409, 410, 426
See application file for complete search history.

(56) References Cited

U.S. PATENT DOCUMENTS 4,190,312 A * 2/1980 Bailey ..... 40/431
4,490,931 A * 1/1985 Fleemin ..... 40/406
4,641,445 A * 2/1987 Rossi ..... 40/410
5,131,175 A * 7/1992 Liu ..... 40/410
5,291,674 A * 3/1994 Torrence ..... 40/410
6,357,151 B1 * 3/2002 Yuen ..... 40/406
6,385,880 B1 * 5/2002 Naragon ..... 40/406
6,449,887 B1 * 9/2002 Song ..... 40/406
2002/0174578 A1 * 11/2002 Ross ..... 40/409

* cited by examiner

*Primary Examiner*—Cassandra Davis

(57) ABSTRACT

An snow globe assembly includes a base member that is adapted for resting upon a horizontal support surface such as a table. The base member has a bottom wall. The base member has a perimeter wall that extends upwardly from the bottom wall. The base member is substantially hollow. A globe member is substantially transparent. The globe member has a perimeter wall that defines an interior space. The globe member is mounted on the base member. The globe member is substantially filled with a liquid media. A quantity of particulate material is temporarily suspendable in the liquid media for simulating snow fall within the globe member. A motor assembly is positioned in the base member. A rotating member is operationally coupled to the motor assembly for causing turbulence in the liquid media for perpetuating a simulated snow fall while the rotating member is rotated.

16 Claims, 5 Drawing Sheets

SNOW GLOBE ASSEMBLY

BACKGROUND OF THE INVENTION

1. Field of the Invention

The present invention relates to globe assemblies and more particularly pertains to a new snow globe assembly for providing a user with a modified globe which would allow particles contained therein to be in continual motion.

2. Description of the Prior Art

The use of globe assemblies is known in the prior art. U.S. Pat. No. 5,666,750 describes a decorative article with flake circulating means. Another type of globe assembly is U.S. Pat. No. 5,816,884 describes a music box having a water pump structure. U.S. Pat. No. 5,864,976 describes a driving mechanism of music snow drop ball which provides a waterproof effect for avoiding rusting of the mechanism. U.S. Pat. No. 5,878,515 describes a driving mechanism of music water ball. U.S. Pat. No. 4,961,276 describes ornamental crystal ball comprising a base, a ball mounted on the base and filled with water, a model disposed in the ball, a plurality of suspensible objects disposed in the ball and a driving apparatus to flow the water and the suspensible objects. U.S. Pat. No. 4,641,445 describes a novelty display device which simulates snow fall.

While these devices fulfill their respective, particular objectives and requirements, the need remains for a device that includes that has certain improved features.

SUMMARY OF THE INVENTION

The present invention meets the needs presented above by incorporating a light member into the present invention for lighting the globe assembly to enhance the visual effect during low light conditions.

Another object of the present invention is to provide a new snow globe assembly presenting a novel eye-catching conversation piece.

Yet another object of the present invention is to provide a new snow globe assembly that would eliminate the need for a user to continually turn the globe upside down in order to create the falling snow effect.

To this end, the present invention generally comprises a base member that is adapted for resting upon a horizontal support surface such as a table. The base member has a bottom wall. The base member has a perimeter wall that extends upwardly from the bottom wall. The base member is substantially hollow. A globe member is substantially transparent. The globe member has a perimeter wall that defines an interior space. The globe member is mounted on the base member. The globe member is substantially filled with a liquid media. A quantity of particulate material is temporarily suspendable in the liquid media for simulating snow fall within the globe member. A motor assembly is positioned in the base member. A rotating member is operationally coupled to the motor assembly for causing turbulence in the liquid media for perpetuating a simulated snow fall while the rotating member is rotated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
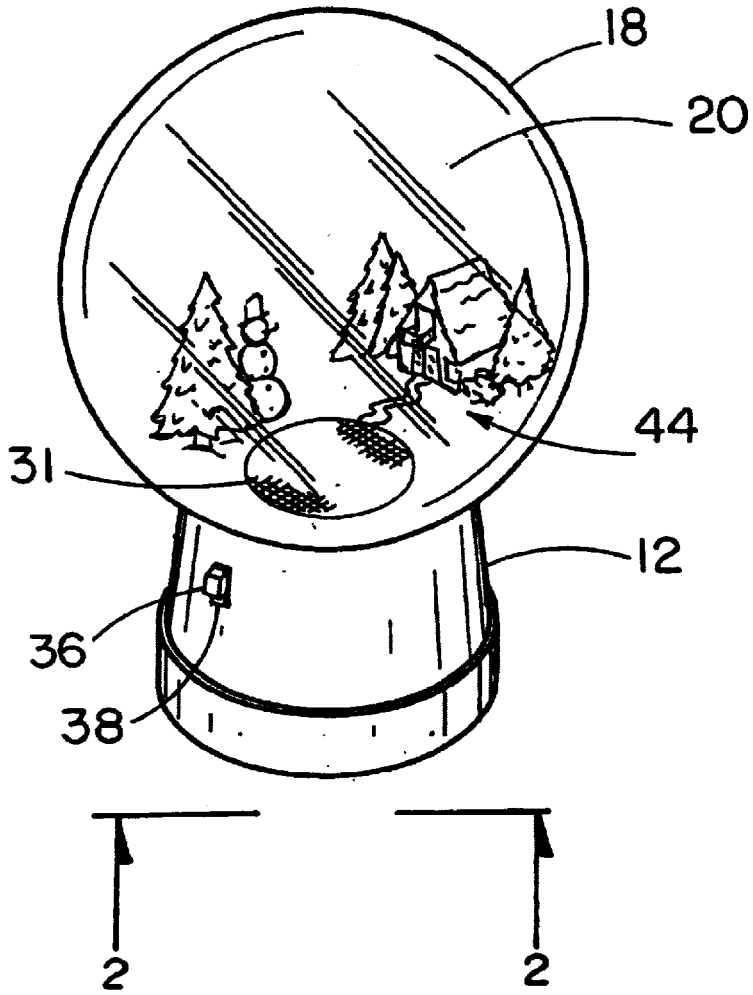
FIG. 1 is a perspective view of a new snow globe assembly according to the present invention.
Figure 2:
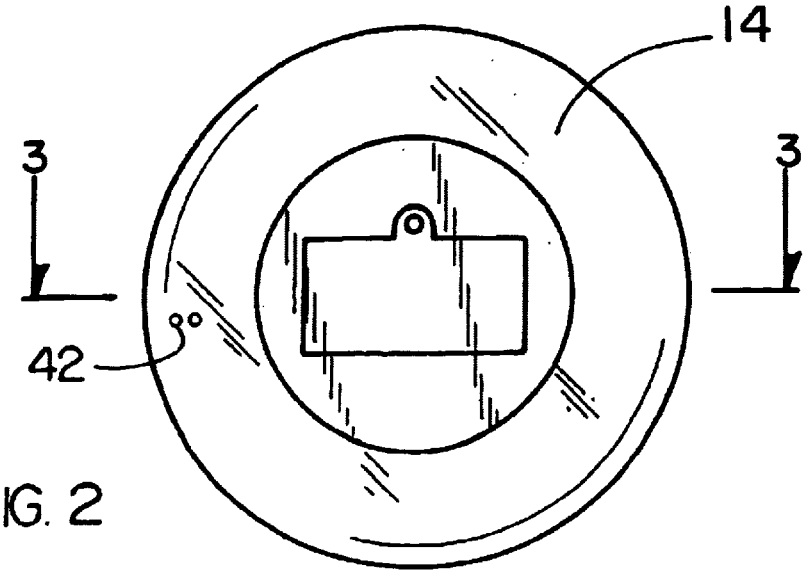
FIG. 2 is a bottom view of the present invention.
Figure 3:
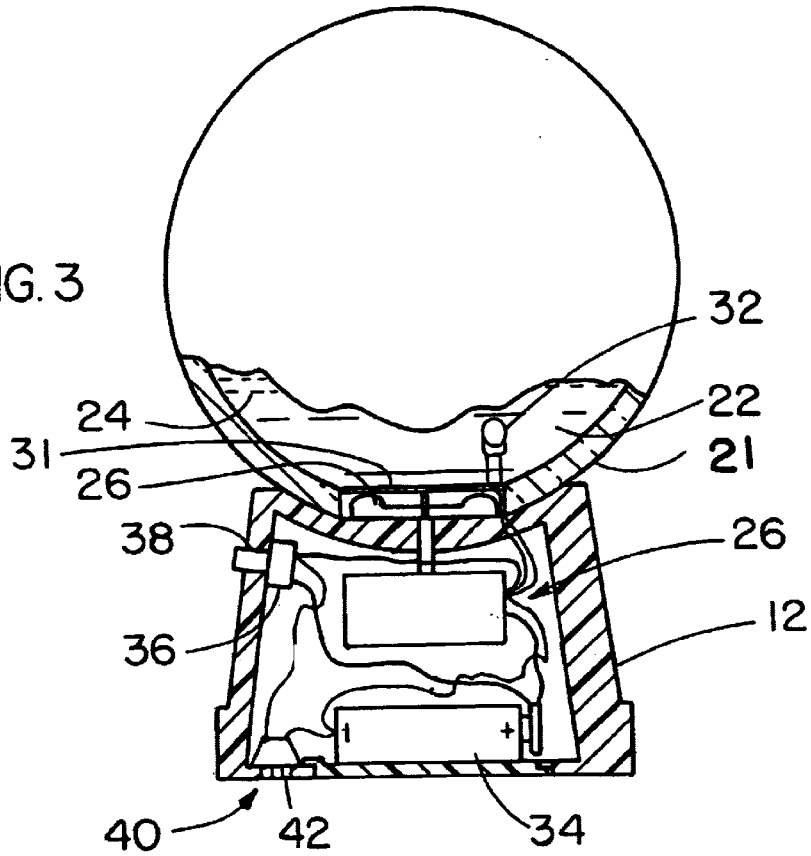
FIG. 3 is a cross-sectional view of the present invention.
Figure 4:
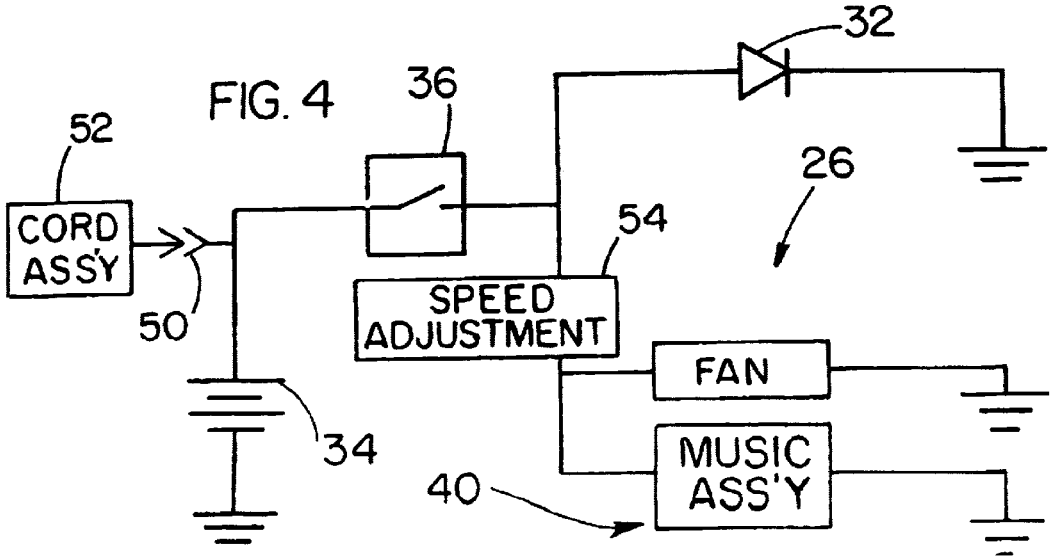
FIG. 4 is a schematic diagram of the present invention.

With reference now to the drawings, and in particular to FIGS. 1 through 7 thereof, a new snow globe assembly embodying the principles and concepts of the present invention and generally designated by the reference numeral 10 will be described.

As best illustrated in FIGS. 1 through 7, the snow globe assembly 10 generally comprises a base member 12 that is adapted for resting upon a horizontal support surface such as a table. The base member 12 has a bottom wall 14. The base member 12 has a perimeter wall that extends upwardly from the bottom wall 14. The base member 12 is substantially hollow. A globe member 18 is mounted on the base member 12. The globe member 18 has a perimeter wall that defines an interior space 20. The perimeter wall is preferably substantially spherical, although some variation from an absolute spherical shape may be employed if desired. The perimeter wall is also substantially transparent, and is preferably substantially transparent about its entirety so as not to block viewing of the interior space 20 and the objects located in the interior space.

The globe member 18 is substantially filled with a liquid media 22, and a quantity of particulate material 24 in the particulate material. The particulate material 24 is characterized by being temporarily suspendable in the liquid media 22 upon disturbance or movement of the liquid media as the particulate material relatively slowly descends through gravitational action in the liquid media, to thereby simulate snow fall in the interior space 20 of the globe member 18.

The invention includes moving means for moving the liquid media 22 inside the interior space 20 of the globe member 18. In one embodiment of the invention, the moving means creates an upward flow of the liquid media in the center of the interior space of the globe member such that a downward movement of the liquid media is created at locations radially outward from the center of the interior space, thus creating an upward movement of the particulate material 24 in the central area of the interior space and a downward movement of the particulate material in a peripheral area of the interior space. In one embodiment of the invention, a small but perceptible amount of air or other gas is located in the interior space of the globe member 18 such that a perceptible vortex may be formed in the interior space of the globe member when the moving means is operating.

In one embodiment of the invention, the moving means is not located in the interior space of the globe member, but is located just below the interior space of the globe member, such as in an aperture formed in a bottom of the perimeter wall 16. Optionally, a screen 21 or other perforated structure may be placed over the moving means to further obscure the moving means from view through the globe member, while not significantly blocking the upward flow of liquid media from the moving means.

The moving means may include a motor assembly 26 is positioned substantially in the base member 12. A rotating member 28, or impeller, is operationally coupled to the motor assembly 26. The rotating member 28 may be positioned in the aperture 30 of the perimeter wall 16, and may be positioned below the screen 30 if such is provided. The rotating member 28 may be provided with blades adapted to produce the upward movement of the liquid media and cause turbulence in the liquid media 22 for creating a movement of the particulate material that simulates snow fall while the rotating member 28 is in operation.

A lamp member 32 is positioned in the globe member. The lamp member 32 provides an illumination for an interior of the globe member 18.

A battery member 34 is positioned substantially within the base member 12. The battery member 34 is for providing electrical energy for the motor assembly 26. A switch member 36 is positioned substantially within the base member 12. The switch member 36 is accessible through a switch aperture 38 in the base member 12. The switch member 36 is operationally coupled between the battery member 34 and the motor assembly 26. The switch member 36 has a first position that permits electrical energy to flow from the battery member 34 to the motor assembly 26. The switch member 36 has a second position that inhibits electrical energy from flowing to the motor assembly 26 from the battery member 34.

A music assembly 40 is for providing a melodic aural signal during operation of the assembly. The music assembly 40 is positioned substantially within the base member 12. The base member 12 has a plurality of music apertures 42 that extend therethrough. The plurality of music apertures 42 facilitates hearing the melodic aural signal.

A scenic assembly 44 is positioned substantially within the globe member 18. The scenic assembly 44 provides a visual background for the simulated snow fall.

In an embodiment an electrical input connector 50 may be operationally coupled to the motor assembly 26. The electrical input connector 50 is preferably coupled to the base member 12. The electrical input connector 50 facilitates supply of electrical energy to the motor assembly 26. A cord assembly 52 is designed to be coupled to a conventional household electrical outlet and to the electrical input connector 50. The cord assembly 52 facilitates supply of electrical current from the conventional household outlet to the electrical input connector 50. The cord assembly may optionally comprise an AC adapter for converting household alternating current to a direct current for the motor assembly 26.

In still a further embodiment of the invention, a speed adjustment means 54 may be operationally coupled to the motor assembly 26 for controlling a speed of operation of the motor assembly 26 such that a speed of rotation of the rotating member 28 is controllable.

Figure 5:
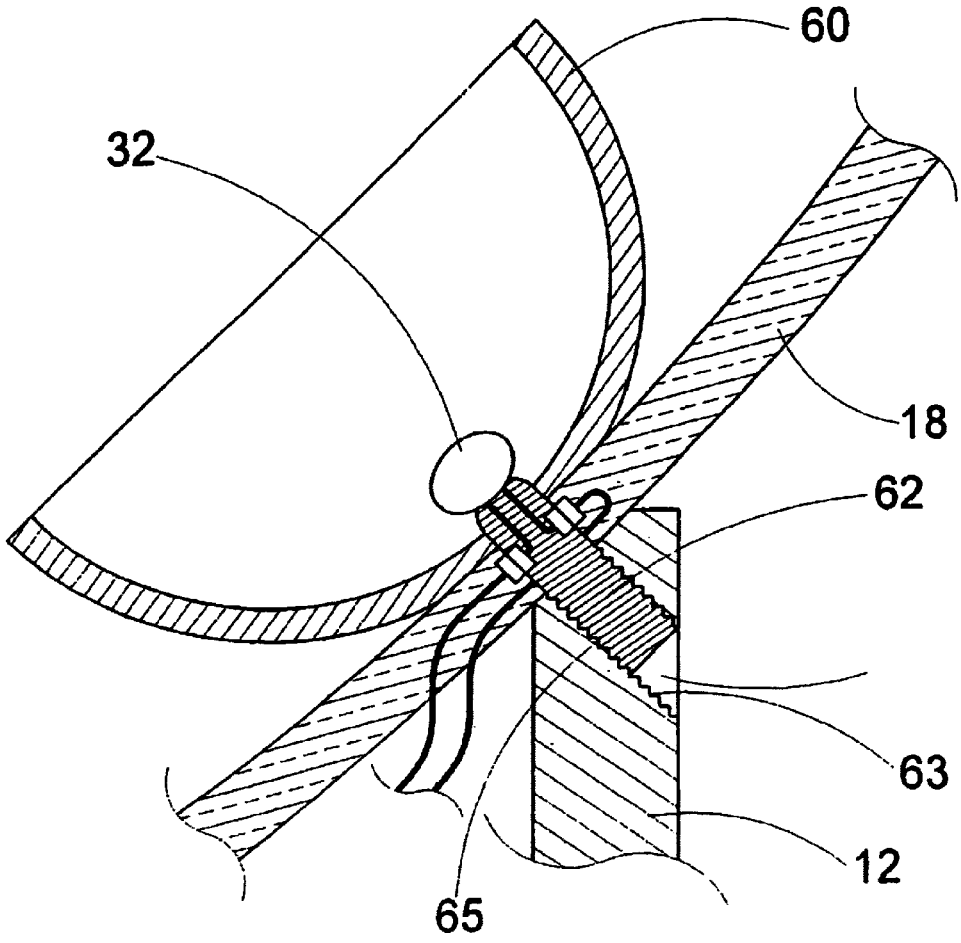
FIG. 5 is a schematic sectional view of a broken away portion of the globe and base members particularly illustrating the removable plug member and channel of the present invention.
Figure 6:
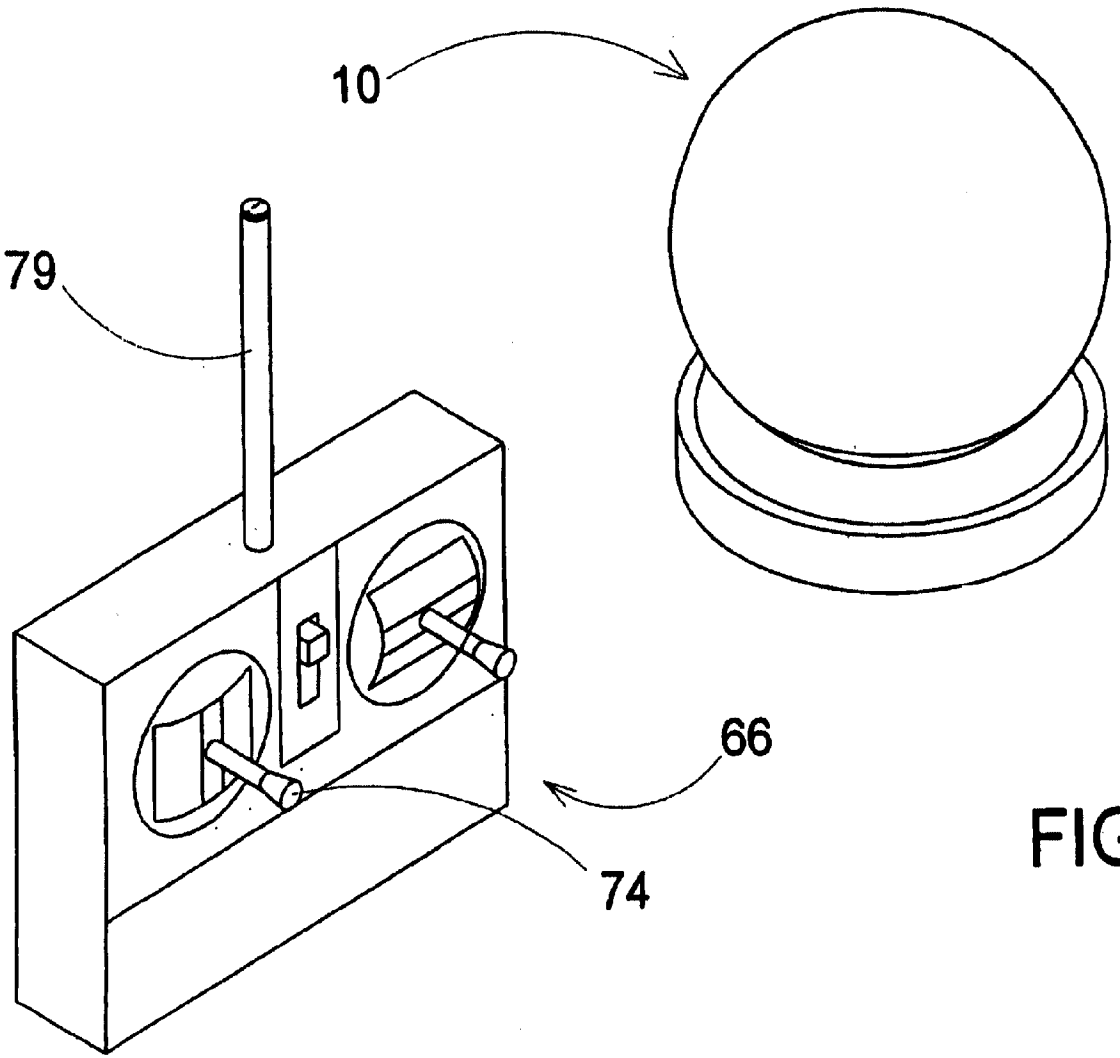
FIG. 6 is a front view of the snow globe assembly and the remote control assembly of the present invention.
Figure 7:
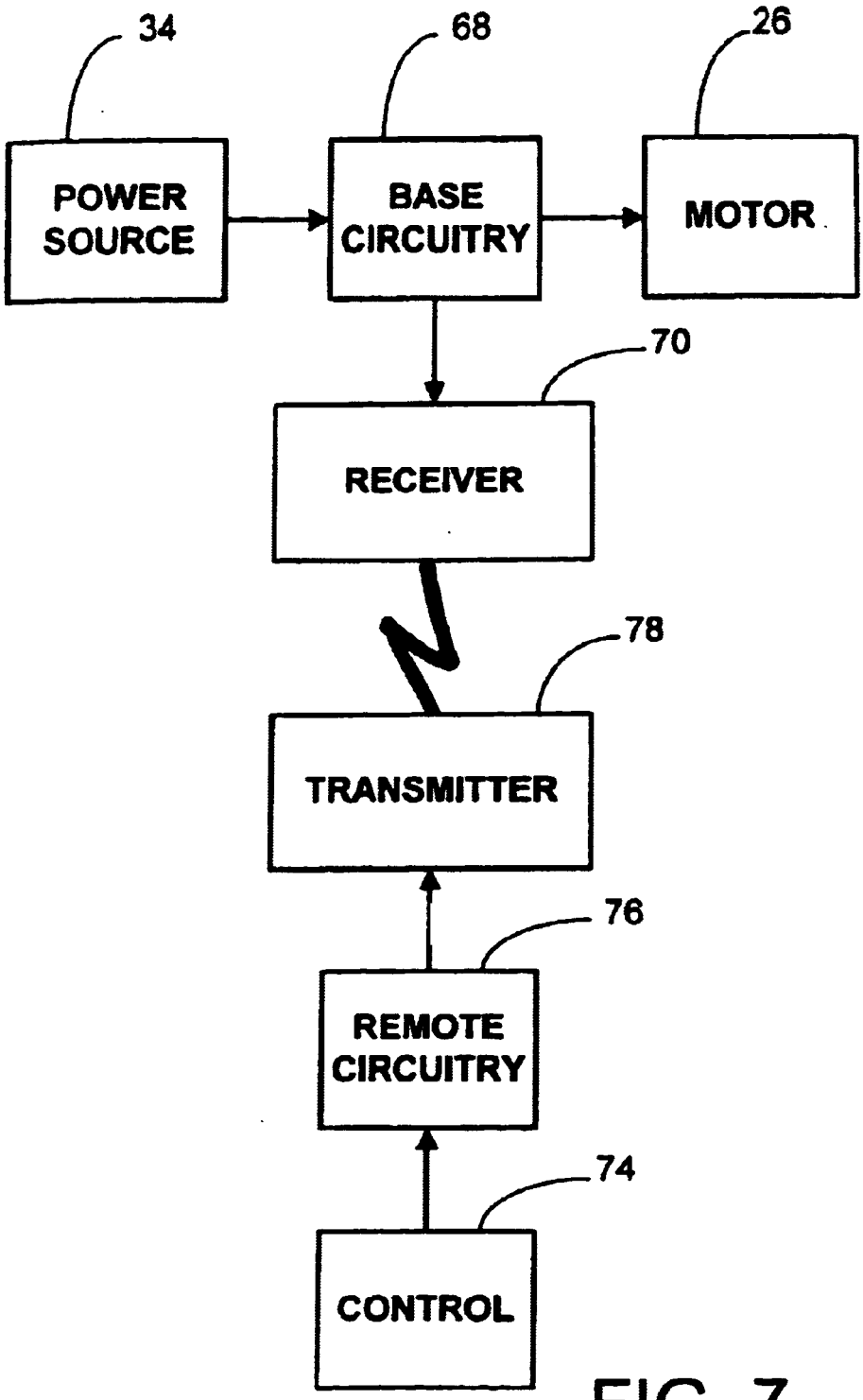
FIG. 7 is a schematic diagram of the remote control assembly of the present invention.

Optionally, the system may include a reflector member 60 for reflecting and diffusing the light emanating from the lamp member 32 (see FIG. 5). The reflector member 60 may be mounted in the interior space of the globe member 18 about the lamp member, and may have a substantially hemispherical shell configuration with the lamp member being positioned in the shell.

As a further option, the lamp member 32 may be removable from the interior space of the globe member to permit replacement of the lamp member. In one embodiment (see FIG. 5), the lamp member 32 is mounted on a plug member 62, and the plug member is removably inserted through the perimeter wall 16 of the globe member 18. The plug member 62 may have threads 65 formed thereon removably mounting the plug member on the base member 12. The base member 12 may have a channel 63 formed therein for removably receiving the plug member. An interior surface of the channel 63 may have threads 65 formed thereon for engaging the threads on the plug member 62 such that rotation of the plug member in a first direction moves the plug member outwardly in the channel and rotation of the plug member in a second direction moves the plug member inwardly in the channel. The plug member and the channel may include suitable electrical contacts to supply electrical power from the channel to the plug member and the light member.

As a still further option, the invention may include a remote control assembly 66 for controlling operation of the motor assembly of the moving means. The remote control assembly may include base circuitry 68 operatively connected to the moving means in a manner permitting controlling operation of the moving means. The base circuitry may be located in the base member, and may be operatively connected to the motor assembly. The base circuitry 68 controls an amount of electrical power flow (from, for example, the battery or electrical outlet) to the motor assembly 26 for controlling a speed of rotation of a shaft of the motor assembly. The base circuitry 68 may include a wireless receiver 70. The remote control assembly 66 may also include a remote housing that is freely movable away from the base member 12. The remote housing 72 may have a control 74 for controlling the motor assembly of the moving means. The remote control assembly 66 may also include remote circuitry 76 that is located in the remote housing and is operatively connected to the control 74. The remote circuitry 76 wirelessly communicates with the base circuitry 68 to control the motor assembly 26 according to movements of the control 74. The remote circuitry may include a wireless transmitter 78 for communicating with the receiver 70 of the base circuitry. In embodiments including the music assembly 40, the operation of the music assembly may also be controlled by the remote control assembly 66. An antenna 79 may be mounted on the remote housing 72 for transmitting to the receiver 70.

In use, a user may activate the switch member on the base member which in turn would activate the motor assembly and the rotating member for circulating the particulate material in the liquid media. A music and light assembly may also be activated to provide audible effects to the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A snow globe assembly comprising:

a base member adapted for resting upon a horizontal support surface said base member having a bottom wall, said base member having a perimeter wall extending upwardly from said bottom wall, said base member being substantially hollow;

a globe member being substantially transparent, said globe member having a perimeter wall defining an interior space said, globe member being mounted on said base member;

a liquid media positioned said interior space of said globe member, said interior space of said globe member being substantially filled with said liquid media;

a quantity of particulate material in said liquid media, said particulate material being temporarily suspendable in said liquid media for simulating snow fall within said globe member;

moving means for moving said liquid media inside the interior space of said globe member in a manner creating an upward flow of said liquid media in a central area of said interior space such that a downward movement of said liquid media is created at locations radially outward from the central area of said interior space to thereby create an upward movement of said particulate material in the central area of said interior space and a downward movement of said particulate material in a peripheral area of said interior space;

a lamp member adapted for illuminating the interior space of said globe member; wherein said lamp member is positioned in the interior space of said globe member and said lamp member has means for removing form the interior space of said globe member for facilitating replacement of said lamp member.

2. The assembly of claim 1 wherein said lamp member is mounted on a plug member said plug member being removably inserted through said perimeter wall of said globe member.

3. The assembly of claim 2 wherein said plug member has threads formed thereon removably mounting said plug member on said base member, said base member having a channel formed therein for removably receiving said plug member, an interior surface of said channel having threads formed thereon for engaging the threads on said plug member such that rotation of said plug member in a first direction moves said plug member outwardly in said channel and rotation of said plug member in a second direction moves said plug member inwardly in said channel.

4. The assembly of claim 1 further comprising a reflector member positioned about said lamp member for reflecting light from said lamp member.

5. The assembly of claim 4 wherein said reflector member is located in the interior space of said globe member.

6. The assembly of claim 4 wherein said reflector member has a substantially hemispherical shape.

7. The assembly of claim 1 wherein a small amount of a gaseous substance is located in the interior space of said globe member such that a vortex may be formed in said interior space when said moving means is operated.

8. The assembly of claim 1 wherein said moving means comprises: a motor assembly positioned in said base member, and a rotating member for creating turbulence in said liquid media, said rotating member being operationally coupled to said motor assembly.

9. The assembly of claim 8 further comprising:

a battery for providing electrical energy for said motor assembly, said battery being positioned in said base member; and a switch positioned in said battery member, said switch being operationally coupled between said battery and said motor assembly, said switch member having a first positioned permitting electrical energy to flow from said battery to said motor assembly said switch having a second positioned inhibiting electrical energy flowing to said motor assembly form said battery.

10. The assembly of claim 8 further comprising:

an electrical input connector operationally coupled to said motor assembly, said electrical input connector facilitating supply of electrical energy to said motor assembly;

a cord assembly adapted for coupling to an electrical input connector, said cord assembly facilitating supply of electrical current from an outlet to said electrical input connector.

11. The assembly of claim 8 further comprising a speed adjustment means for controlling a speed of rotation of said motor assembly such that a speed of rotation of said rotating member is controllable said speed adjustment means being operationally coupled to said motor assembly.

12. The assembly of claim 1 further comprising remote control means for controlling operation of said moving means, said remote control means comprising:

base circuitry operatively connected to said moving means in a manner permitting controlling operation of said moving means, said base circuitry being located in said base member, a remote housing freely movable away from said base members, said remote housing having a control for controlling the moving means;

remote circuitry located in said remote housing and being operatively connected to said control, said remote circuitry wirelessly communicating with said base circuitry to control said moving means according to movement of said control.

13. The assembly of claim 12 wherein said moving means includes a motor assembly, said base circuitry being operatively connected to said motor assembly, said base circuitry controlling an amount of electrical power flow to said motor assembly for controlling a speed of rotation of said motor assembly, said base circuitry including a wireless receivers said remote circuitry including a wireless transmitter.

14. The assembly of claim 1 further comprising a music assembly for providing a melodic aural signal during operation of said music assembly.

15. The assembly of claim 1 further comprising a scenic assembly for providing a visual background for said simulated snow fall, said scenic assembly being positioned in the interior space of said globe member.

16. A snow globe assembly comprising:

a base member adapted for resting upon a horizontal support surface Said base member having a bottom wall, said base member having a perimeter wall extending upwardly from said bottom wall, said base member being substantially hollow;

a globe member being substantially transparent, said globe member having a perimeter wall defining an interior space, said globe member being mounted on said base member; a liquid media positioned said interior space globe member, said interior space of said globe member being substantially filled with said liquid media;

a quantity of particulate material in said liquid media, said particulate material being temporarily suspendable in said liquid media for simulating snow fall within said globe member;

moving means for moving said liquid media inside the interior space of said globe member in a manner creating an upward flow of said liquid media in a central area of said interior space such that a downward movement of said liquid media is created at locations radially outward from the central area of said interior space to thereby created an upward movement of said particulate material in the central area of said interior space and a downward movement of said particulate material in a peripheral area of said interior space, a small amount of a gaseous substance being located in the interior space of said globe member such that a vortex may be formed in said interior space when said moving means is operated, a lamp member adapted for illuminating the interior space of said globe member, said lamp member being positioned in the interior space of said globe member, said lamp member being removable form the interior space of said globe member for facilitating replacement of said lamp member, said lamp member being mounted on a plug member, said lamp member being mounted on a plug member, said plug member, said plug member being removably inserted through said perimeter wall of said globe member, said plug member having threads formed thereon removably mounting said plug member on said base member, said base member having a channel formed therein for removably receiving said plug member, an interior surface of said channel having threads formed thereon for engaging the threads on said plug member such that rotation of said plug member in a first direction moves said plug member outwardly in said channel and rotation of said plug member in a second direction moves said plug member inwardly in said channel;

a reflector member positioned about said lamp member for reflecting light from said lamp member, said reflector member being located in the interior space of said globe member, said reflector member having a substantially hemispherical shape;

wherein said moving means comprises:

a motor assembly positioned in said base member; and a rotating member for creating turbulence in said liquid media, said rotating member being operationally coupled to said motor assembly;

remote control means for controlling operation of said moving means, said remote control means comprising:

base circuitry operatively connected to said moving means in a manner permitting controlling operation of said moving means, said base circuitry being located in said base member a remote housing freely movable away from said base member, said remote housing having a control for controlling the moving means;

remote circuitry located in said remote housing and being operatively connected to said control, said remote circuitry wirelessly communicating with said base circuitry to control said moving means according to movements of said control;

wherein said base circuitry controls an amount of electrical power flow to said motor assembly for controlling a speed of rotation of said motor assembly, said base circuitry including a wireless receiver, said remote circuitry including a wireless transmitter;

a battery for providing electrical energy for said motor assembly, said battery being positioned in said base member, and a switch positioned in said base member, said switch being operationally coupled between said battery and said motor assembly, said switch member having a first positioned permitting electrical energy to flow from said battery to said motor assembly, said switch having a second positioned inhibiting electrical energy flowing to said motor assembly from said battery;

a music assembly for providing a melodic aural signal during operation of said music assembly;

a scenic assembly for providing a visual background for said simulated snow fall, said scenic assembly being positioned in the interior space of said globe member;

an electrical input connector operationally coupled to said motor assembly, said electrical input connector being coupled to said base member, said electrical input connector facilitating supply of electrical energy to said motor assembly;

a cord assembly adapted for coupling to an electrical outlet, said cord assembly being couplable to said electrical input connector, said cord assembly facilitating supply of electrical current form the outlet to said electrical input connector;

a speed adjustment means for controlling a speed of rotation of said motor assembly such that a speed of rotation of said rotating member is controllable, said speed adjustment means being operationally coupled to said motor assembly.

* * * * *